US010181630B2

(12) United States Patent
Doll et al.

(10) Patent No.: US 10,181,630 B2
(45) Date of Patent: Jan. 15, 2019

(54) DIRECTIONAL COUPLER AND A COMBINER

(71) Applicant: Rohde & Schwarz GmbH & Co. KG, Munich (DE)

(72) Inventors: Christopher Doll, Poing (DE); Ludwig Moll, Raisting (DE)

(73) Assignee: Rohde & Schwarz GMBH & Co. KG, Munich (DE)

( * ) Notice: Subject to any disclaimer, the term of this patent is extended or adjusted under 35 U.S.C. 154(b) by 0 days.

(21) Appl. No.: 15/231,084

(22) Filed: Aug. 8, 2016

(65) Prior Publication Data

US 2018/0040938 A1 Feb. 8, 2018

(51) Int. Cl.
*H01P 5/18* (2006.01)
*H01P 3/12* (2006.01)

(52) U.S. Cl.
CPC ..... *H01P 5/182* (2013.01)

(58) Field of Classification Search
CPC ..... H01P 5/181
USPC ..... 333/109, 111
See application file for complete search history.

(56) References Cited

U.S. PATENT DOCUMENTS 2,632,809 A 3/1953 Riblet
2,817,063 A * 12/1957 Kurtz ..... H01P 5/182 333/113
32,304,282 1/1966 Cohn
3,916,352 A * 10/1975 Powell ..... H01P 1/209 333/208
4,679,011 A * 7/1987 Praba ..... H01P 5/182 333/111
5,196,812 A * 3/1993 Drost ..... H01P 5/182 333/113
5,247,268 A * 9/1993 Meise ..... H01P 5/04 333/111
9,136,578 B2 * 9/2015 Nguyen ..... H01P 5/12

FOREIGN PATENT DOCUMENTS

DE 1038621 B 9/1958
GB 1356317 A 6/1974

OTHER PUBLICATIONS

Deng, Compact full Ka-band waveguide diractional coupler based on large aperture array, Electronics Let, IEE Stevenage, vol. 52, No. 11, pp. 936-937, May 26, 2016.

* cited by examiner

*Primary Examiner* — Dean Takaoka
(74) *Attorney, Agent, or Firm* — Schwabe, Williamson & Wyatt, P.C.

(57) ABSTRACT

A directional coupler is described comprising two housing parts which define at least two hollow conductors and a separation wall positioned between both hollow conductors. Said separation wall comprises several holes ensuring a coupling of the at least two hollow conductors. Said several holes are arranged in two rows in an alternating manner such that a galvanic connection of both housing parts is provided between each neighbored holes. Further, a combiner is described.

13 Claims, 3 Drawing Sheets

DIRECTIONAL COUPLER AND A COMBINER

FIELD OF THE INVENTION

The invention relates to a directional coupler, in particular a power directional coupler having a coupling with low losses, and a combiner.

BACKGROUND

In general, directional couplers comprise at least two hollow conductors for conducting electromagnetic waves. The hollow conductors are also called wave guides, hollow wave guides, rectangular wave guides, HF-wave guides, hollow-metallic wave guides, etc. Hereinafter, the term hollow conductor is used for such an item. The directional couplers are passive components which are used in the field of high frequency engineering for splitting, decoupling or coupling electromagnetic waves guided through at least one of the hollow conductors. Several directional couplers can be used to form a combiner which is a cascaded arrangement of directional couplers and, thus, a combiner is also called cascaded power combiner. Since the several directional couplers are combined in a cascaded manner, the combiner can be used to combine several electromagnetic waves, for instance.

Typically, the hollow conductors are brazed or welded together along two side walls of the hollow conductors facing each other. These side walls are perforated in order to provide a coupling portion for the electromagnetic waves enabling an interaction of the electromagnetic waves propagating through the hollow conductors. Ensuring the interaction, many holes and/or slits are provided in the coupling portion wherein the number of holes and/or slits increases dramatically when a coupling with low losses (good coupling) shall be achieved, for instance a 3 dB coupling.

In general, the size and the position of the holes and/or slits result from a complex function in order to ensure the good coupling. This complicates the manufacturing of the directional coupler significantly. The same applies for the manufacturing of a combiner comprising several directional couplers.

Further, the combiner needs a lot of space due to the many holes and/or slits of each directional coupler when 3 dB directional couplers are used.

DISCLOSURE OF INVENTION

The invention provides a directional coupler comprising two housing parts which define at least two hollow conductors and a separation wall positioned between both hollow conductors, the separation wall comprising several holes ensuring a coupling of the at least two hollow conductors, wherein the several holes are arranged in two rows in an alternating manner such that a galvanic connection of both housing parts is provided between each neighbored holes.

Further, the invention provides a combiner comprising several power directional couplers as mentioned above.

The invention is based on the finding that a broad band directional coupler having low losses and small dimensions, in particular a compact 3 dB power directional coupler, can be provided if a coupling portion is established by holes which are arranged in at least two rows in an alternating manner such that a continuous galvanic connection is provided in the separation wall between each neighbored holes. The continuous galvanic connection extends substantially perpendicular to the propagation direction of the electromagnetic waves in the hollow conductors. Further, the continuous galvanic connection has a straight-lined component extending from the bottom of the directional coupler to the top of the directional coupler along the separation wall. Thus, the galvanic connection is parallel to one dimension of the separation wall, in particular its height. In general, the continuous galvanic connection is established by the material of the separation wall.

The several holes can be arranged in two rows in an alternating manner such that the holes do not overlap in a top view on the directional coupler. This means that neighbored holes of a first row are distanced from each other such that the space between them in this row is larger than the hole in the second row being disposed between the mentioned neighbored holes of the first row in a top view on the directional coupler. Due to this dimensions of the holes and their distances to each other, a galvanic connection is ensured between each neighbored holes of all rows, in particular over the whole separation wall.

Particularly, both housing parts are connected to each other in a connecting plane where the current density of the electromagnetic signals is very low propagating through the hollow conductors. For instance, the connecting plane of both housing parts is in the middle of the height of each hollow conductor being perpendicular to the propagation direction of the electromagnetic waves. Thus, the housing parts are housing halves. The directional coupler comprises two housing parts having exactly the same height. Since the current density of the electromagnetic signals is very low in the connecting plane (middle of the height of the hollow conductors), inevitable manufacturing tolerances and slits which might occur during manufacturing of the directional coupler have no influence on the performance of the directional coupler. Accordingly, both housing parts have hollow conductor portions which define the hollow conductors when the housing parts are assembled.

Further, the directional coupler can be an asymmetrical directional coupler having an odd number of inputs, in particular three or five inputs. Since a good coupling of the directional coupler, in particular a 3 dB coupling, is ensured, it is possible that the number of inputs is odd. Therefore, the number of electromagnetic waves which can be coupled in the directional coupler increases whereas the dimension of the directional coupler does not increase proportional with the number of inputs.

According to an aspect, each of the housing parts has a separation base of the separation wall wherein each separation base comprises at least one row of the holes. The separation base of the separation wall corresponds to a portion of the separation wall, in particular exactly a half of the separation wall. The separation base of one housing part limits the holes provided in the separation base of the other housing part.

Both housing parts, in particular their separation bases, can be connected to each other at the boundary of each hole, in particular a corner portion. This ensures that a galvanic connection of both housing parts is provided between each neighbored holes which extends continuously from the bottom to the top of a directional coupler along the separation wall. Hence, the galvanic connection between each hole is provided over the entire height of the hollow conductors being perpendicular to the propagation direction of the electromagnetic waves.

Further, both housing parts may be different, in particular their separation bases. Thus, the different arrangement of the holes in the coupling portion of the assembled separation wall can be established easily. Only, the outer dimensions of the housing parts as well as hollow conductor portions formed in the housing parts have to be similar in order to obtain a directional coupler having a compact design and good coupling portions. Due to the displaced rows of holes, the separation bases of each housing part defining the coupling portion when assembled can be different to each other.

Particularly, the number of holes provided in the separation bases of both housing parts is different. Another variance for adjusting the characteristics of the directional coupler is obtained, namely the number of holes of each row as no hole pairs are used.

According to another aspect, the holes are milled in the separation wall, in particular the separation base of each housing part. Since the holes are open to the connection plane of the dedicated housing part, the holes may be milled completely in the separation bases. Thus, a repeatable manufacturing process can be used for machining the holes wherein the process is suitable for low manufacturing tolerances. In addition, the manufacturing costs are low.

Particularly, the hollow conductor portions of each housing part are also open to the connection plane. Thus, the hollow conductor portions can also be milled. Therefore, at least all structures opened to the connecting plane can be milled which simplifies the manufacturing process reducing the costs.

Further, the surface of the housing parts defining the hollow conductors may be electromagnetically conductive, in particular metalized. This ensures that the electromagnetic waves propagate between electromagnetically conductive surfaces of the hollow conductors ensuring that the electromagnetic waves are confined by the electromagnetically conductive walls. For instance, the walls which surfaces define the hollow conductors can be made of a metal. Alternatively, the walls can be made of a ceramic and/or a plastic material wherein the surfaces defining the hollow conductors are metalized in order to ensure that the electromagnetic waves are confined in the hollow conductors.

Particularly, the housing parts are made of metal. Thus, the manufacturing steps are minimized as the whole housing parts are made of metal. Accordingly, a metallization step of the surfaces is not needed in order to achieve electromagnetically conductive surfaces limiting the hollow conductors. The structures used for the hollow conductors and the coupling portion, in particular the holes, can be easily machined.

The directional coupler may be a power directional coupler. Hence, the directional coupler is used to combine several electromagnetic waves. For instance, the direction coupler is a power direction coupler having a 3 dB coupling.

BRIEF DESCRIPTION OF DRAWINGS

The invention will now be described with reference to a preferred embodiment which is shown in the enclosed drawings. In the drawings, FIG. 1 schematically shows a directional coupler according to the invention in a cross section along its length.

DETAILED DESCRIPTION OF EXAMPLES EMBODIMENTS

Figure 1:
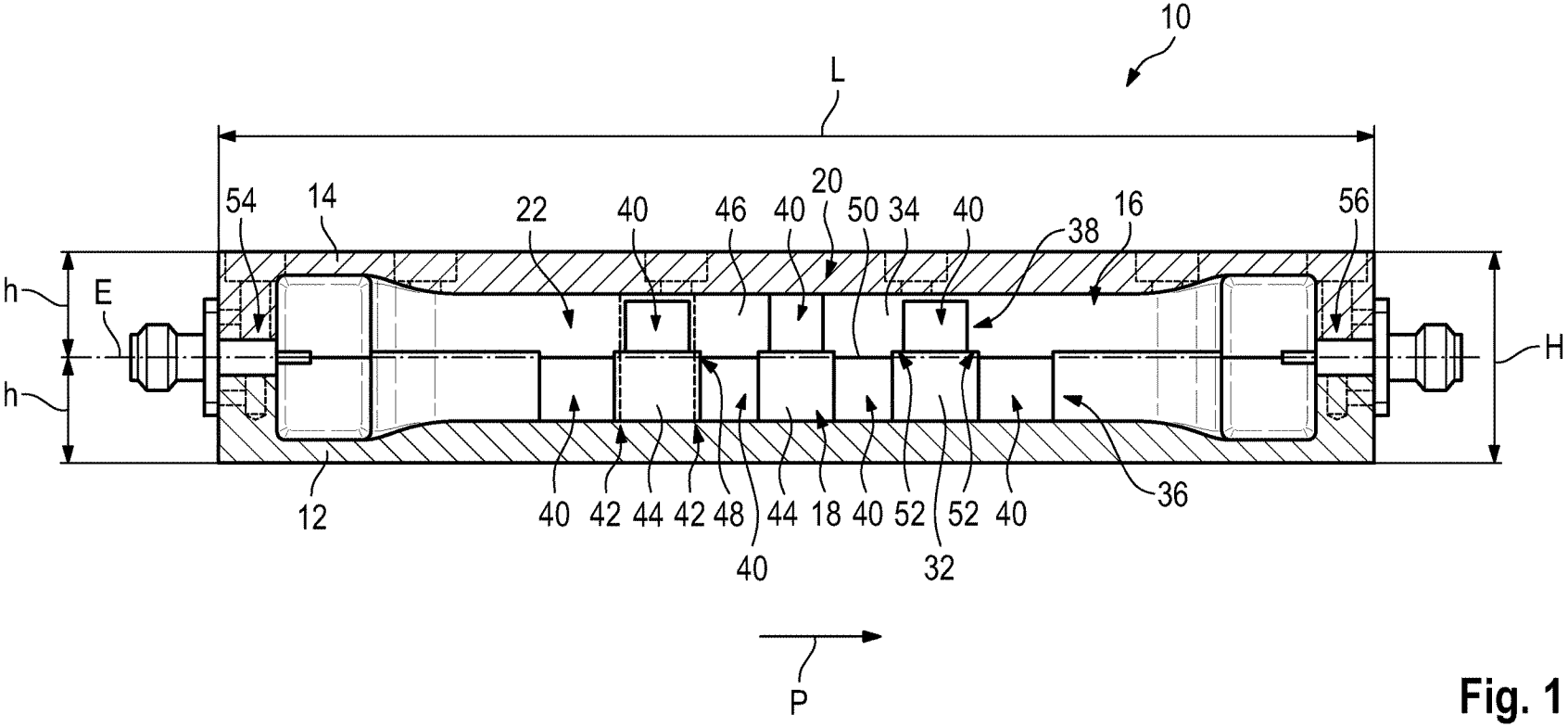

FIG. 1 schematically shows a directional coupler 10 which is formed by two housing parts 12 and 14 which are also called lower housing part and upper housing part.

Figure 2:
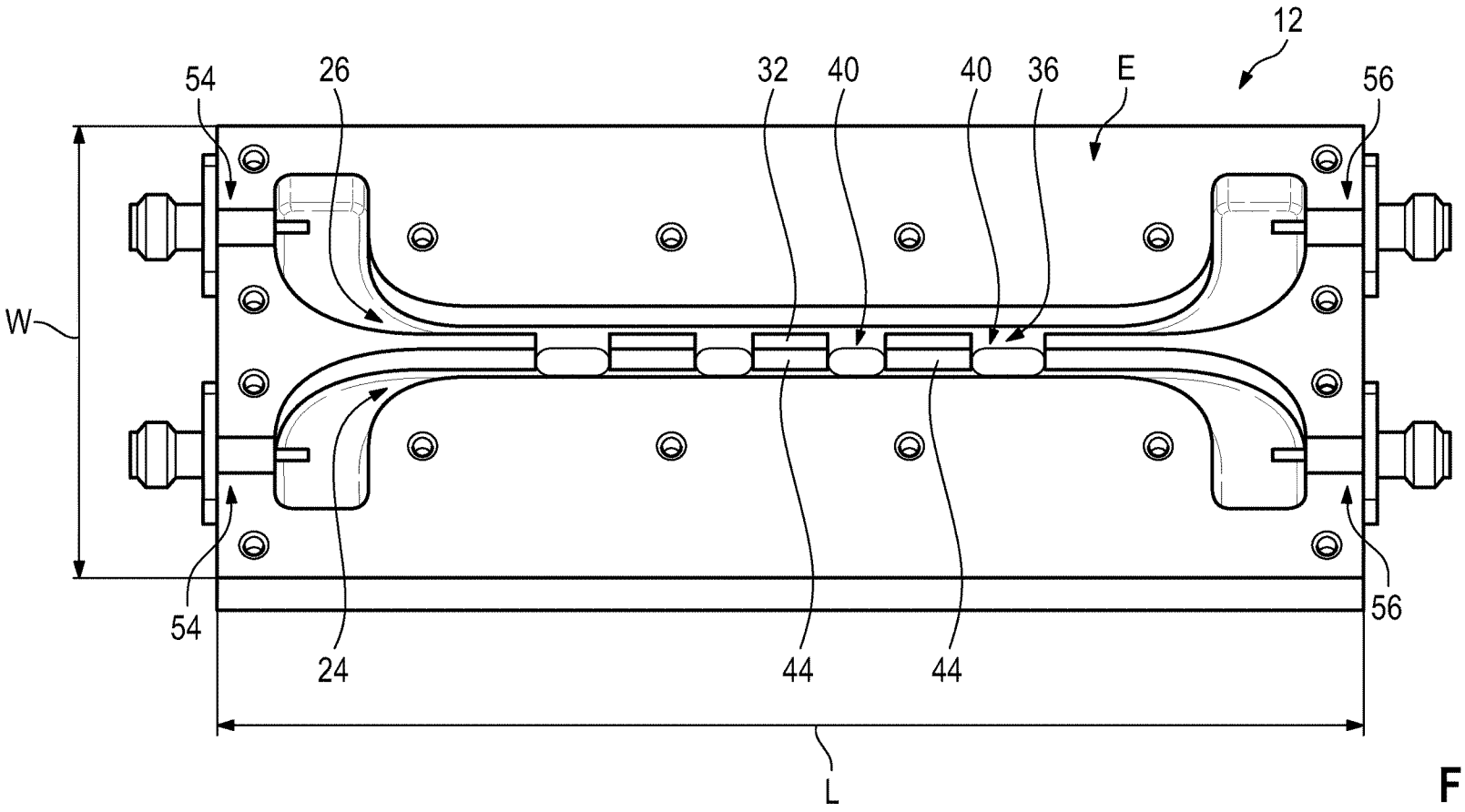
FIG. 2 shows a perspective view on the lower housing part of the directional coupler of FIG. 1, in particular its connecting plane.
Figure 3:
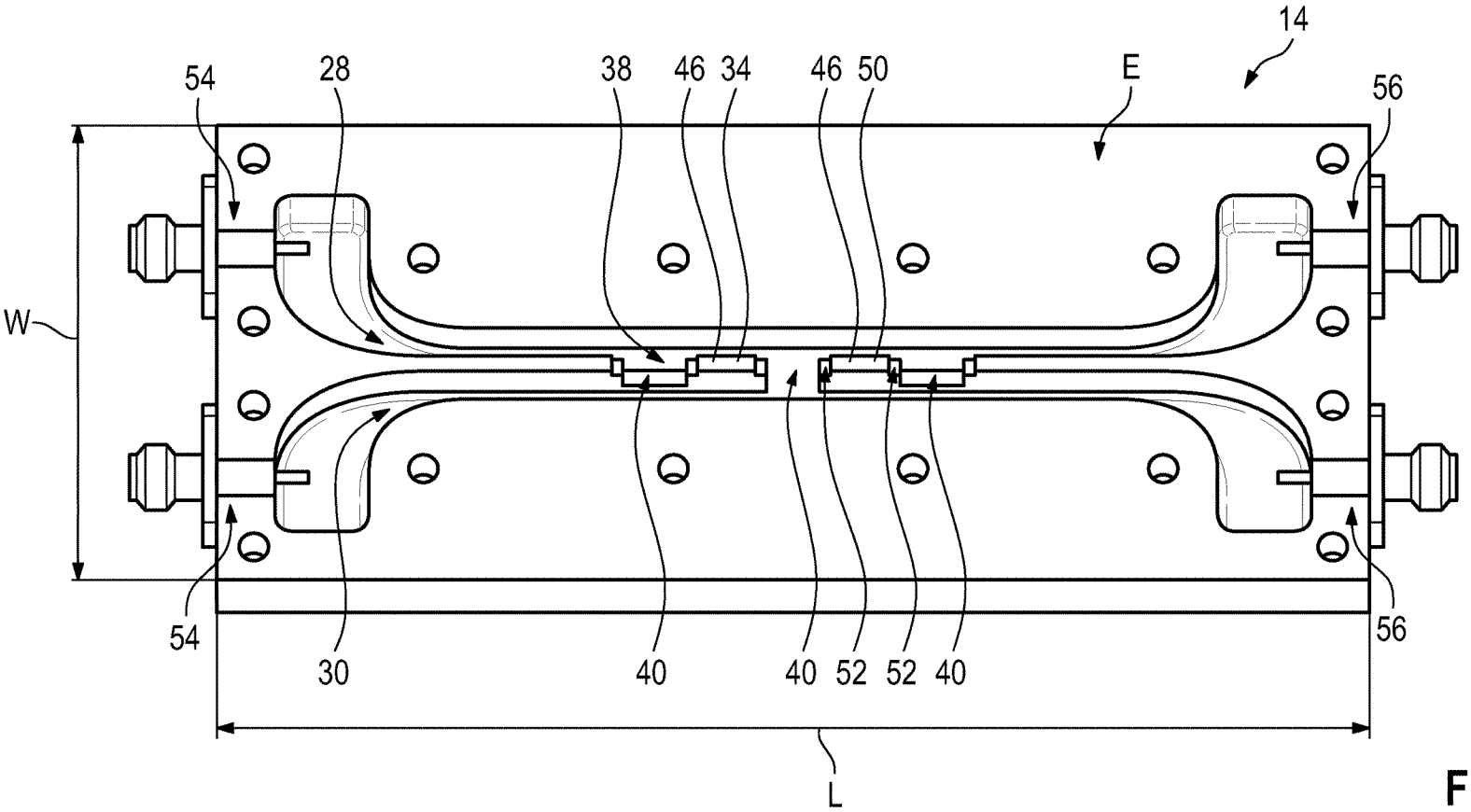
FIG. 3 shows a perspective view on the upper housing part of the directional coupler of FIG. 1, in particular its connecting plane.

Both housing parts 12, 14 are shown in FIGS. 2 and 3 independently in more detail, in particular the lower housing part 12 is shown in FIG. 2 whereas the upper housing part 14 is shown in FIG. 3. In the following, reference is also made to these Figures.

The directional coupler 10 comprises a separation wall 16 and two hollow conductors 18, 20 which are separated by the separation wall 16. In FIG. 1, the first hollow conductor 18 is in front of the separation wall 16 whereas the second hollow conductor 20 is partly covered by the separation wall 16.

In general, the separation wall 16 has a coupling portion 22 ensuring the coupling of electromagnetic waves propagating through the hollow conductors 18, 20 as will be described later.

As shown in FIGS. 2, 3, each housing part 12, 14 comprises in the shown embodiment two hollow conductor portions 24, 26, 28, 30 defining the hollow conductors 18, 20 as well as a separation base 32, 34, respectively (please refer to FIGS. 2 and 3).

The lower housing part 12 comprises the hollow conductor portions 24, 26 as well as the separation base 32 whereas the upper housing part 14 comprises the hollow conductor portions 28, 30 as well as the separation base 34.

Both housing parts 12, 14 are connected to each other in a connecting plane E (please refer to FIG. 1) in order to form the assembled directional coupler 10. Accordingly, this connecting plane E is represented by the top surfaces of the housing parts 12, 14 shown in FIGS. 2, 3.

Assembling the directional coupler 10, the upper housing part 14 is turned by 180° with respect to the position shown in FIG. 3 and then superposed on the lower housing part 12 such that both top surfaces shown in FIGS. 2, 3 contact each other. Accordingly, the hollow conductor portions 24, 28 form the first hollow conductor 18 being in front of the separation wall 16 with regard to FIG. 1 whereas the hollow conductor portions 26, 30 form the second hollow conductor 20 being behind the separation wall 16 with regard to FIG. 1. In addition, the separation bases 32, 34 form the separation wall 16 of the assembled directional coupler 10.

As shown in FIG. 1, the housing parts 12, 14 are housing halves as the housing parts 12, 14 have exact same height h wherein the assembled directional coupler 10 has the height H. Further, the directional coupler 10 has a length L which corresponds to the length of the housing parts 12, 14. The length L is substantially parallel to the propagation direction of the electromagnetic waves through the hollow conductors 18, 20 indicated by the arrow P.

As shown in FIGS. 2, 3, the directional coupler 10 has a width W which corresponds to the width of the housing parts 12, 14.

Accordingly, the assembled directional coupler 10 has the dimensions W×H×L wherein each of the housing parts 12, 14 being housing halves has the dimensions W×h×L.

Since both housing parts 12, 14 are housing halves, the separation bases 32, 34 each correspond exactly to one half of the assembled separation wall 16. In addition, the hollow conductor portions 24-30 also corresponds exactly to a half of each hollow conductor 18, 20, in particular its volume which can be filled with air.

Further, the connecting plane E is substantially parallel to the propagation direction P of the electromagnetic waves, in particular in a coupling area defined by the coupling portion 22. Additionally, the connecting plane E is exactly in the middle of the hollow conductors 18, 20 with regard to the height H of the directional coupler 10. Accordingly, the connecting plane E is located in an area where the current density of the electromagnetic waves propagating through the hollow conductors 18, 20 is minimal. Thus, unavoidable manufacturing tolerances do not impair the coupling properties of the directional coupler 10.

Referring to FIG. 1, the assembled separation wall 16 comprises two rows 36, 38 of holes 40 which define the coupling portion 22 connecting the hollow conductors 18, 20 defined by the housing parts 12 and 14. The first row 36 is provided in the lower housing part 12 (please refer to FIG. 2) and the second row 38 is provided in the upper housing part 14 (please refer to FIG. 3). Since both housing parts 12, 14 are combined in a superposed manner, the assembled directional coupler 10 comprises two rows 36, 38 provided in the assembled separation wall 16 as shown in FIG. 1.

In the shown embodiment, the first row 36 of holes 40 provided in the lower housing part 12 comprises four holes 40 each having different sizes whereas the second row 38 of holes 40 provided in the upper housing part 14 comprises three holes 40 each having different sizes. However, the holes 40 are rectangular. Alternatively, the holes 40 have a different shape.

The separation bases 32, 34 do contact each other between two neighbored holes 40 of both rows 36, 38. Thus, a continuous galvanic connection 42 is ensured between two neighbored holes 40 provided in the assembled separation wall 16. The continuous galvanic connection 42 is highlighted by a dashed line in FIG. 1.

Each of the separation bases 32, 34 comprises a wall portion 44, 46 which in top view on the direction coupler 10 form an overlapping area 48 with the separation base 32, 34 of the other housing part 12, 14. Accordingly, the galvanic connections 42 extend continuously from the bottom to the top of the directional coupler 10 along the separation wall 16. Hence, the galvanic connections 42 extend substantially perpendicular to the propagation direction P of the electromagnetic waves in the hollow conductors 18. 20.

In other words, there is no overlapping area of the holes 40 with regard to a top view of the directional coupler 10.

Since the holes 40 of each housing part 12, 14 are open to its top surface defining the connecting plane E, the holes 40 can be easily manufactured by milling. The "open holes" of each housing part 12, 14 are closed by the separation bases 32, 34 of the other housing part 12, 14, in particular the wall portions 44, 46.

As shown in FIG. 3, the wall portions 46 of the separation base 34 of the upper housing part 14 have small protrusions 50 forming adjacent shoulder areas 52.

In FIG. 1, it becomes obvious that the edges of the wall portions 46 of the lower housing part 12 contact the shoulder areas 52 such that the wall portions 46 are maintained in a form-fit manner regarding the propagation direction P as well as perpendicular to the propagation direction P, in particular in a direction corresponding to the height.

Hence, the separation bases 32, 34 of both housing parts 12, 14 can be connected to each other via the protrusions 50 and shoulder areas 52, in particular in axial direction of the directional coupler 10 corresponding to the propagation direction P as well as perpendicular thereto. The connecting area corresponds to the overlapping area 48.

The connection of both separation bases 32, 34 may be established around the corner formed by the boundary of the holes 40.

The galvanic connection 42 is established at least by the dimension of the shoulder area 52, in particular its length.

According to another embodiment, the lower housing part 12 and the upper housing part 14 are formed vice versa such that the lower housing part 12 comprises protrusions and/or shoulder areas.

Alternatively, the housing parts 12, 14 may be connected to each other via plane surfaces provided at the separation bases 32, 34, in particular the wall portions 44, 46, wherein these plane surfaces face each other.

In the shown embodiment, the directional coupler 10 comprises two inputs 54 and two outputs 56. Accordingly, the directional coupler 10 is a so called 2×2 directional coupler. Each input 54, output 56 is engaged by a coaxial cable.

Alternatively, the directional coupler 10 can have another number of inputs 54 and outputs 56, in particular an odd number of inputs 54 due to the good coupling, for instance three or five inputs 54.

The distance between the inputs 54 and/or the outputs 56 is minimized to an absolute minimum due to the coupling portion 22 ensuring the coupling with low losses, for instance a 3 dB coupling.

Thus, a directional coupler 10 is provided which has small dimensions whilst ensuring good coupling properties.

The invention claimed is:

1. A directional coupler comprising two housing parts which define at least two hollow conductors and a separation wall positioned between both hollow conductors, said separation wall comprising several holes ensuring a coupling of the at least two hollow conductors, wherein said several holes are arranged in two rows in an alternating manner such that a galvanic connection of both housing parts is provided between each neighbored holes, each of said housing parts having a separation base of said separation wall.

2. The directional coupler according to claim 1, wherein said several holes are arranged in two rows in an alternating manner such that said holes do not overlap in a top view on said directional coupler.

3. The directional coupler according to claim 1, wherein both housing parts are connected to each other in a connection plane where the current density of electromagnetic signals is very low propagating through said hollow conductors.

4. The directional coupler according to claim 1, wherein the number of holes of both housing parts is different.

5. The directional coupler according to claim 1, wherein said directional coupler is an asymmetrical directional coupler having an odd number of inputs, in particular three or five inputs.

6. The directional coupler according to claim 1, wherein each separation base comprises at least one row of said holes.

7. The directional coupler according to claim 1, wherein said separation bases for both housing parts are connected to each other at a boundary of each hole, in particular a corner portion.

8. The directional coupler according to claim 1, wherein said separation bases for both housing parts are different.

9. The directional coupler according to claim 1, wherein said holes are milled in said separation wall, in particular in said separation bases of each housing part.

10. The directional coupler according to claim 1, wherein surfaces of said housing parts defining said hollow conductors are electromagnetically conductive, in particular metalized.

11. The directional coupler according to claim 1, wherein said housing parts are made of metal.

12. The directional coupler according to claim 1, wherein said directional coupler is a power directional coupler.

13. A combiner comprising several directional couplers according to one of the preceding claims.

* * * * *